US007849891B2

(12) United States Patent
Hashiba et al.

(10) Patent No.: US 7,849,891 B2
(45) Date of Patent: Dec. 14, 2010

(54) DEVICE AND METHOD FOR MEASURING HARD GRANULAR OBJECTS

(75) Inventors: Yoshitugi Hashiba, Fukushima (JP); Hitoshi Takahashi, Fukushima (JP); Eisaku Takahashi, Fukushima (JP)

(73) Assignee: Kureha Corporation, Tokyo (JP)

( * ) Notice: Subject to any disclaimer, the term of this patent is extended or adjusted under 35 U.S.C. 154(b) by 1082 days.

(21) Appl. No.: 10/567,080

(22) PCT Filed: Aug. 5, 2004

(86) PCT No.: PCT/JP2004/011268

§ 371 (c)(1),
(2), (4) Date: Oct. 27, 2006

(87) PCT Pub. No.: WO2005/012101

PCT Pub. Date: Feb. 10, 2005

(65) Prior Publication Data

US 2007/0095425 A1 May 3, 2007

(30) Foreign Application Priority Data

Aug. 5, 2003 (JP) ..... 2003-205992

(51) Int. Cl.
*B65B 1/04* (2006.01)

(52) U.S. Cl. ..... 141/249; 141/81; 141/248; 222/346; 222/361

(58) Field of Classification Search ..... 141/10, 141/81, 248, 249; 222/344, 346, 361–363
See application file for complete search history.

(56) References Cited

U.S. PATENT DOCUMENTS 2,405,507 A * 8/1946 Lefren ..... 222/137
2,761,588 A * 9/1956 Shields ..... 222/148
3,185,190 A * 5/1965 Crawford ..... 141/360
3,604,057 A * 9/1971 Nixdorff, Jr. ..... 222/137
4,635,829 A * 1/1987 Brittingham, Jr. ..... 222/278
4,721,233 A * 1/1988 Asada ..... 222/245
4,733,803 A * 3/1988 Sisson et al. ..... 222/276
5,409,137 A * 4/1995 Bonomelli ..... 222/56
5,685,461 A * 11/1997 Mitchell ..... 222/184
6,050,308 A * 4/2000 Wurst et al. ..... 141/81
6,131,766 A * 10/2000 King et al. ..... 222/1
6,148,636 A * 11/2000 Wade, Jr. ..... 222/361
6,811,061 B2 * 11/2004 Tuvim ..... 222/361

FOREIGN PATENT DOCUMENTS

| | | |
|---|---|---|
| JP | 05-305901 | 11/1993 |
| JP | 08-034401 | 2/1996 |
| JP | 2002-136574 | 5/2002 |
| KR | 299019 | 1/2003 |

* cited by examiner

*Primary Examiner*—Gregory L Huson
*Assistant Examiner*—Nicolas A Arnett
(74) *Attorney, Agent, or Firm*—Reed Smith LLP

(57) ABSTRACT

A device for measuring a hard granular object. The device includes a measuring vessel, a holder, a shutter, and a pressing means for pressing the holder against the measuring vessel. The measuring vessel includes a first face, a second face parallel to the first face, and a space formed between the first and second faces for receiving hard granular object supplied from first face side. The holder is located on the side of the first face., includes a through hole communicable with the space, and is slidable along the first face. The shutter is located on the side of the second face, includes a through hole communicable with the space, and is movable parallel to the second face.

19 Claims, 4 Drawing Sheets

View taken in direction of arrow X

DEVICE AND METHOD FOR MEASURING HARD GRANULAR OBJECTS

TECHNICAL FIELD

The present invention relates to a device and a method for measuring a hard granular object, and, in particular, to a device and a method for measuring a hard granular object into which fine granules not to be measured are or have been mixed during the measurement process or before. The present invention also relates to a device for measuring a hard granular object which would not be damaged by such fine granules and a method for measuring a hard granular object therewith.

BACKGROUND ART

Conventionally, measuring vessels have been used to measure a granular object such as powdery or granular medicine. As shown in FIG. 4, a measuring vessel 1 is a rectangular parallelepiped made of stainless steel and having a space with a capacity equal to the volume of the granular object to be measured. A holder 2 also made of stainless steel is placed on the measuring vessel 1. The holder 2 has a through hole communicable with the space of the measuring vessel 1. The granular object is fed into the through hole and, when the through hole of the holder 2 is communicated with the space of the measuring vessel 1, the space of the measuring vessel 1 can be filled with the granular object.

A shutter 4 is disposed under the measuring vessel 1. The shutter 4 also has a through hole communicable with the space of the measuring vessel 1. In the configuration, when the through hole of the shutter 4 is communicated with the space of the measuring vessel 1, the granular object filling up the space of the measuring vessel 1 falls through the through hole of the shutter 4. Thereupon, the measuring vessel 1 reciprocates horizontally, and a step of communicating the space of the measuring vessel 1 with the through hole of the holder 2 so that the space of the measuring vessel 1 is filled with the granular object and a step of communicating the space of the measuring vessel 1 with the through hole of the shutter 4 so that the granular object filling up the space of the measuring vessel 1 falls through the through hole of the shutter 4 are performed alternately and repeatedly.

When granular object which has high hardness, such as spherical adsorptive carbon, or which contains fine granules or generates fine granules during processing, is measured, the fine granules are caught between the measuring vessel 1 and the holder 2 or the shutter 4 as the measuring vessel 1 slides relatively on the holder 2 or the shutter 4, causing a damage to the measuring vessel 1, the holder 2, and/or shutter 4. Also, since the measuring vessel 1 slides on the holder 2 and the shutter 4, the contact surfaces thereof are subjected to abrasion. Therefore, a spare measuring vessel and so on for replacement must be prepared so that the measuring vessel and so on can be replaced when damaged.

DISCLOSURE OF THE INVENTION

Problem to be Solved by the Invention

However, since the parts, especially the measuring vessel, are machined with high precision, it is not desirable from the viewpoint of operating efficiency and economic efficiency to replace them every time they are damaged. It is, therefore, an object of the present invention to provide a device for measuring a hard granular object having a measuring vessel, a holder, and a shutter which are not damaged by a granule caught between them when used to measure a granular object with high hardness and to provide a method for measuring hard a granular object therewith. Another object of the present invention is to provide a device and a method for measuring a hard granular object such as spherical adsorptive carbon, which may contain fine granules, with removing fine granules from the hard granular object.

Means for Solving the Problem

In accomplishing the above objects, a device 20 for a measuring hard granular object according to the present invention comprises: a measuring vessel 21 having a first face 21*d*, a second face 21*e* parallel to the first face 21*d*, and a space 21*a* formed between the first face 21*d* and the second face 21*e* for receiving a hard granular object supplied from the first face 21*d* side; a holder 22 located on the side of the first face 21*d*, having a through hole 22*a* communicable with the space 21*a*, and slidable along the first face 21*d*; a shutter 24 located on the side of the second face 21*e*, having a through hole 24*a* communicable with the space 21*a*, and movable parallel to the second face 21*e*; and a pressing means 23 for pressing the holder 22 toward the measuring vessel 21.

In this configuration, since the holder is pressed toward the measuring vessel and the first face of the measuring vessel and a face of the holder are kept in close contact with each other, the granular object is less likely to be caught between the faces to cause damage to the measuring vessel and the holder. The faces are flat to the extent that the measuring vessel and the holder can slide along each other as described above. The first face and second face of the measuring vessel are not necessarily precisely parallel but are parallel to the extent that the measuring vessel can slide along the face of the holder and move in parallel to a face of the shutter. The hard granular object is a granular object which is so hard that it can scratch or damage the holder, the measuring vessel, and/or the shutter when caught between the holder and the measuring vessel or between the measuring vessel and the shutter.

In a device for measuring a hard granular object according to the present invention, as shown in FIG. 1 for example, in the described device 20, there may be kept a designated gap d between the second face 21*e* and the shutter 24.

In this configuration, since there is a designated gap between the second face of the measuring vessel and the shutter, fine granules in the granular object can be removed from the space of the measuring vessel and the measuring vessel and shutter can move easily relative to each other. Here, the designated gap is a gap with a width smaller than the diameter of the hard granular object to be measured and greater than the diameter of the fine granules not to be measured.

In a device for measuring a hard granular object according to the present invention, for example as shown in FIG. 1, in any device 20 described above, the holder 22 may be pressed toward the measuring vessel 21 with a force smaller than that required to crush the hard granular object.

In this configuration, even if a hard granular object is caught between the holder and the measuring vessel, the hard granular object is not crushed and therefore a large amount of fine granules are not generated.

In a device 20 for measuring a hard granular object according to the present invention, for example as shown in FIG. 1, in any device 20 described above, a part of the first face 21*d* which slides on the holder 21 may be made of an abrasion resistant material 21*b*.

In this configuration, since the face of the measuring vessel which slides on the holder is made of an abrasion resistant material, the measuring vessel is not likely worn down when sliding on the holder.

In a device 20 for measuring a hard granular object according to the present invention, for example as shown in FIG. 1, in any device 20 described above, a part of the holder 22 which slides on the measuring vessel 21 may be made of an acetal resin or polyether-ether-ketone.

In this configuration, since the holder is made of a soft material, the holder can be kept in close contact with the first face of the measuring vessel and the granular object is less likely to be caught between them. And, since the holder is made of a slippery material, the measuring vessel and the holder can move easily relative to each other. In addition, since the holder is made of an acetal resin or polyether-ether-ketone, it is easy to be formed and to be replaced when worn down.

In a device 20 for measuring a hard granular object according to the present invention, for example as shown in FIG. 1, in any device 20 described above, a part of the second face 21*e* facing the shutter may be made of an abrasion resistant material 21*c*.

In this configuration, since the second face of the measuring vessel is formed of an abrasion resistant material, the measuring vessel is less likely to be worn down or damaged by the discharged fine granules when the measuring vessel and the shutter move relative to each other.

In a device 20 for measuring a hard granular object according to the present invention, for example as shown in FIG. 1, in any device 20 described above, the space 21*a* of the measuring vessel 21 for receiving the hard granular object may have an opening with its unchamfered edge in the first face 21*d*.

In this configuration, the hard granular object is less likely to be caught between the holder and the measuring vessel.

In a device 20 for measuring a hard granular object according to the present invention, for example as shown in FIG. 1, in any device 20 described above, the space 21*a* of the measuring vessel 21 for receiving the hard granular objects may have an opening with its unchamfered edge in the second face 21*e*.

In this configuration, the hard granular object is less likely to be caught between the measuring vessel and the shutter.

In order to achieve the above objects, as shown in FIG. 2 for example, a method for measuring a hard granular object according to the present invention, comprises steps of: charging the space 21*a* of the measuring vessel 21 with a hard granular object to be measured from a holder 22 of any one of the above measuring device (see FIG. 2A); closing the openings of the space in the first and second faces of the measuring vessel 21, filled with the hard granular object (see FIG. 2B); and discharging the hard granular object from the space 21*a* of the measuring vessel 21 (see FIG. 2C).

In this configuration, there can be obtained a method for measuring a hard granular object which does not cause hard granular object to be caught between the measuring vessel and the holder or the shutter to damage the measuring vessel, the holder, and/or the shutter. Also, there can be obtained a measuring method with which fine granules not to be measured can be removed.

The basic Japanese Patent Application No. 2003-205992 filed on Aug. 5, 2003 is hereby incorporated in its entirety by reference into the present application.

The present invention will become more fully understood from the detailed description given hereinbelow. However, the detailed description and the specific embodiment are illustrated of desired embodiments of the present invention and are described only for the purpose of explanation. Various changes and modifications will be apparent to those ordinary skilled in the art within the spirit and scope of the present invention on the basis of the detailed description.

The applicant has no intention to give to public any disclosed embodiments. Among the disclosed changes and modifications, those which may not literally fall within the scope of the present claims constitute, therefore, a part of the present invention in the sense of doctrine of equivalents.

The use of the terms "a" and "an" and "the" and similar referents in the specification and claims are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention unless otherwise claimed.

Effects of the Invention

As described previously, utilizing the device and method for measuring a hard granular object according to the present invention, it is possible to measure a hard granular object without allowing fine granules to mix in the measured hard granular object even when the hard granular object contains fine granules or generates fine granules during processing. Also, since the measuring device is less likely to be damaged by fine granules, the measuring device and measuring method is particularly suitable for use in measuring a hard granular object containing fine granules.

BEST MODE FOR CARRYING OUT THE INVENTION

The embodiments of the present invention are hereinafter described with reference to the drawings. The same or corresponding devices are denoted in all the drawings with the same reference numerals, and the repeated description is omitted.

A device for measuring spherical adsorptive carbon according to a first embodiment of the present invention is described with reference to the cross-sectional view of FIG. 1. A measuring vessel 21 is a metal rectangular parallelepiped which has a space 21*a* having a capacity corresponding to the volume of spherical adsorptive carbon to be measured and opening in two parallel opposing faces 21*d* and 21*e* of the measuring vessel 21. The measuring vessel 21 is placed such that the space 21*a* opens vertically with the face 21*d* up. The space 21*a* preferably has a circular cylindrical shape so that it can be easily formed, but may be of another shape. The measuring vessel 21 may be in the form of a circular or oval plate or may be of another shape as long as it has the two parallel faces 21*d* and 21*e* where a space has its opening. The measuring vessel 21 is preferably made of stainless steel so that it can be less likely to be damaged by spherical adsorptive carbon but may be made of another metal. Alternatively, the measuring vessel 21 may be made of, for example, an engineering plastic resin as a hard material other than metals because it is hard and light.

The top face of the measuring vessel 21 is formed by a thin plate 21*b* of ceramic as an abrasion resistant material. The thin plate 21*b* may be made of an abrasion resistant material other than ceramic. Alternatively, an abrasion resistant material may be coated on the surface. The thin plate 21*b* may be formed over the entire surface of the top face of the measuring vessel 21 or over only a part of the top face of the measuring vessel 21 on which a holder 22 slides, which is described later. The upper opening of the space 21*a* has an unchamfered, right-angle edge. When the measuring vessel 21 is made of a hard material such as stainless steel, the measuring vessel 21 may not be provided with the thin plate 21*b* as an abrasion resistant material and have a surface formed of stainless steel.

A part of the bottom face of the measuring vessel 21 facing a shutter 24, which is described later, is formed by a thin plate 21*c* of ceramic as an abrasion resistant material. The thin plate 21*c* may be made of an abrasion resistant material other than ceramic. Alternatively, an abrasion resistant material may be coated on the surface. A part of the bottom face of the measuring vessel 21 not facing the shutter 24 may be formed by a material with abrasion resistance or a material without abrasion resistance. For example, the part facing the shutter 24 is made of a laminate of an abrasion resistant material. The thin plate 21*c* may be formed over the entire surface of the bottom face of the measuring vessel 21 or over only a part of the bottom face of the measuring vessel 21 on which the shutter 24 slides which is described later. The lower opening of the space 21*a* has an unchamfered, right-angle edge. When the measuring vessel 21 is made of a hard material such as stainless steel, the measuring vessel 21 may not be provided with the thin plate 21*c* of an abrasion resistant material and have a surface formed of stainless steel.

The measuring vessel 21 is, as shown in a view taken in the direction of arrow X in FIG. 1, horizontally movable by wheels 25*a* attached thereto and fixed rails 25*b*. The measuring vessel 21 is driven by an actuator (not shown) and reciprocates horizontally. The supporting method for allowing the horizontal movement of the measuring vessel 21 may be by other means such as a linear guide or a linear bearing.

A holder 22 is placed on the top face 21*d* of the measuring vessel 21. The holder 22 is a rectangular parallelepiped, and a part of the holder 22 which slides on the measuring vessel 21 is made of an acetal resin or polyether-ether-ketone. A material other than acetal resin or polyether-ether-ketone can be suitably used as long as it has high hardness, high abrasion resistance and a low friction coefficient. Examples of materials with high abrasion resistance include polyphenylene sulfide resins, polyamide-imide resins, polyarylate resins, polyethersulfone resins, polyimide resins, polyallylether-nitrile resins, and ultra-high molecular weight polyethylene resins. A metal such as stainless steel may be also used. The remaining part of the holder 22 other than the part which slides on the measuring vessel 21 may be made of another resin. The part sliding on the measuring vessel 21 and the other part can be made of different materials by, for example, utilizing a laminate structure. The holder 22 is not necessarily a rectangular parallelepiped as long as it has a flat face which can be in contact with the measuring vessel 21. The holder 22 has a through hole 22*a* extending from the face in contact with the measuring vessel 21 to the top face thereof. The through hole 22*a* preferably has the same cross-section as the space 21*a* of the measuring vessel 21 but may have a different cross-section from that of the space 21*a*. The lower opening of the through hole 22*a* has an unchamfered, right-angle edge.

The holder 22 is restrained from moving horizontally and supported so as not to tilt by a guide (not shown). The holder 22 has its top face pressed downward by two springs 23 as pressing means having upper parts fixed to a filling nozzle 16 and a dummy nozzle 16*a*, respectively. The bottom face of the holder 22 is in contact with the top face 21*d* of the measuring vessel 21 such that it pressures on the top face 21*d*. The two springs 23 are disposed in the traveling direction of the measuring vessel 21. Since the holder 22 is pressed by the two springs 23, the holder 22 can press the measuring vessel 21 uniformly even when the measuring vessel 21 is moved horizontally and the measuring vessel 21 can be moved smoothly. The springs may be coil springs, plate springs or other types of springs. The number of the springs is not limited to two and may be one or several. Preferably, plural of springs are disposed in the traveling direction of the measuring vessel 21. The upper parts of the springs may be fixed to a fixed beam or the like, not to the filling nozzle 16 and the dummy nozzle 16*a*. The pressure of the holder 22 on the measuring vessel 21 caused by the springs 23 is within such a range that a spherical adsorptive carbon granule is not crushed even if it is caught between the measuring vessel 21 and the holder 22. Therefore, even if the spherical adsorptive carbon granule is caught between the measuring vessel 21 and the holder 22, the granule cannot be crushed to generate a large amount of fine granules. Any pressing means other than springs may be used. For example, the holder 22 may be pressed by fluidic pressure such as hydraulic or pneumatic pressure, magnetic force, or elastic force other than spring force. The holder 22 may press the measuring vessel 21 with its own weight or may press with its own weight and an additional weight of a weight attached thereto.

A shutter 24 is placed below the measuring vessel 21 with a designated gap d therebetween. The shutter 24 is a metallic, rectangular parallelepiped having a top face parallel to the bottom face 21*e* of the measuring vessel 21. The shutter 24 is preferably made of stainless steel but may be made of another metal or a hard material such as an engineering plastic resin. The shutter 24 is not necessarily a rectangular parallelepiped as long as it has a top face parallel to the bottom face 21*e* of the measuring vessel 21. The shutter 24 has a through hole 24*a* extending from the face facing the measuring vessel 21 to the bottom face thereof. The through hole 24*a* preferably has the same cross-section as the space 21*a* of the measuring vessel 21 but may have a different cross-section from that of the space 21*a* when its cross-section is larger than that of the space 21*a*. The upper opening of the through hole 24*a* has an unchamfered, right-angle edge.

The shutter 24 is fixedly supported with a gap d between its top face and the bottom face 21*e* of the measuring vessel 21. The width of the gap d has to be smaller than any of the diameters of the granular object (spherical adsorptive carbon, in this embodiment) to be measured and greater than the diameter of fine granules not to be measured. Then, since the granules of the granular object to be measured are not caught in the gap d and since fine granules are not slid in the gap d, measurement can be made without damaging the measuring device and fine granules can be discharged through the gap d between the measuring vessel 21 and the shutter 24.

The operation of the measuring device is next described with reference to the cross-sectional view of FIG. 2. Here, a measuring device for measuring spherical adsorptive carbon with a diameter between 0.05 and 1 mm is described as an example. As shown in FIG. 2A, when the measuring vessel 21 is in such a position that the space 21*a* is in communication with the through hole 22*a*, spherical adsorptive carbon is supplied from the filling nozzle 16 the end of which is positioned above or in the through hole 22*a*. The spherical adsorptive carbon passes through the through hole 22*a* and enters the space 21*a* of the measuring vessel 21. Since the lower opening of the space 21*a* is closed by the top face of the shutter 24, the spherical adsorptive carbon is heaped up in the space 21*a*. The spherical adsorptive carbon is supplied from the filling nozzle 16 in an amount greater than the capacity of the space 21*a*, and the spherical adsorptive carbon which cannot enter the space 21*a* is heaped up in the through hole 22*a*.

As shown in FIG. 2B, when a small amount of spherical adsorptive carbon is heaped up in the through hole 22*a*, the measuring vessel 21 starts being moved horizontally. In FIG. 2B, the measuring vessel 21*a* is moved in an arrow direction. Then, the upper opening of the space 21*a* is gradually closed by the holder 22. The spherical adsorptive carbon in the through hole 22*a* is left behind in the through hole 22*a*, and eventually remains in the through hole 22*a* when the lower opening of the through hole 22*a* is closed by the top face 21*d* of the measuring vessel 21. The spherical adsorptive carbon may continue to be supplied from the filling nozzle 16 or may be stopped by a valve or the like after the measuring vessel 21 has started being moved.

The space 21*a* is closed as the lower opening is closed by the top face of the shutter 24 and the upper opening is closed by the bottom face of the shutter 22, and the spherical adsorptive carbon in the space 21*a* is moved together with the measuring vessel.

When the measuring vessel 21 is moved until the lower opening of the space 21*a* overlaps the upper opening of the through hole 24*a* of the shutter 24 as shown in FIG. 2C, the spherical adsorptive carbon in the space 21*a* starts falling through the through hole 24*a*. The lower opening of the through hole 24*a* is communicated with a chute pipe (not shown), and the spherical adsorptive carbon is transported for the next process.

When the lower opening of the space 21*a* completely overlaps the through hole 24*a*, all the spherical adsorptive carbon in the space 21*a* falls. After that, the measuring vessel 21 is moved in the opposite direction, and the lower opening of the space 21*a* is closed by the top face of the shutter 24 and the upper opening of the space 21*a* overlaps the lower opening of the through hole 22*a* of the holder 22. Then, the spherical adsorptive carbon remaining in the through hole 22*a* falls into the space 21*a* and more spherical adsorptive carbon is supplied from the filling nozzle 16 into the space 21*a*. Every time the above operation is repeated, spherical adsorptive carbon in an amount corresponding to the capacity of the space 21*a* of the measuring vessel 21 is measured and transported for the next process. Since the measurement by the measuring vessel 21 is performed 30 to 50 times per minute, the measuring vessel 21 is moved very quickly.

Since the holder 22 is pressed toward the measuring vessel 21 by the springs 23, the holder 22 and the measuring vessel 21 are reliably kept in close contact with each other during the above operation. In case that there is a gap between the top face 21*d* of the measuring vessel and the bottom face of the holder 22 where the spherical adsorptive carbon granules are heaped up over the capacity of the space 21*a* and the measuring vessel is then moved, the spherical adsorptive carbon granules existing over the capacity of the space 21*a* may be left in the thorough hole 22*a* of the holder and may enter the gap. The spherical adsorptive carbon granule having entered the gap is rubbed against the top face 21*d* of the measuring vessel 21 and the bottom face of the holder 22 between them. Since spherical adsorptive carbon is hard, the surfaces of the top face 21*d* of the measuring vessel 21 and the bottom face of the holder 22 are rubbed and scratched by the granule of spherical adsorptive carbon. However, since the holder 22 and the measuring vessel 21 are reliably kept in close contact with each other, no granule of spherical adsorptive carbon can be caught between them and the holder 22 and the measuring vessel 21 are not damaged.

Also, since the upper opening of the space 21*a* has an unchamfered, right-angle edge and the lower opening of the through hole 22*a* has an unchamfered, right-angle edge, a granule of spherical adsorptive carbon is less likely to be caught between the top face 21*d* of the measuring vessel 22 and the bottom face of the holder 22. When the edges are chamfered, a granule of spherical adsorptive carbon is caught between the chamfered edges. Then, when the measuring vessel 22 is moved, the granule of spherical adsorptive carbon presses the chamfers. As a result, a force is generated in such a direction as to move the measuring vessel 21 downward or to move the holder 22 upward, and the granule of spherical adsorptive carbon is more likely to be caught between them.

Also, since the top face 21*d* is made of an abrasion resistant material, the measuring vessel 21 is not easily worn and has a long service life even though it is slid with the holder pressed against it.

Since the holder 22 is made of an acetal resin, polyether-ether-ketone or the like, the friction between the holder 22 and the measuring vessel 21 is so small that the measuring vessel 21 can be easily reciprocated horizontally. Also, since such a material is soft, the holder 22 can be kept in close contact with the measuring vessel 21. In addition, since the holder 22 is made of a soft material, the measuring vessel 21 is not worn even through the measuring vessel 21 slides on the holder 22. Since the holder 22 is made of an acetal resin, polyether-ether-ketone or the like, it is easy to be formed and to be replaced easily when worn out.

Since a granule of spherical adsorptive carbon collides with each other or is rubbed against the outer walls and so on and their surfaces are scraped off when they are conveyed in the space 21*a* of the measuring vessel 21 or supplied into the space 21*a*, fine granules of adsorptive carbon are mixed in the spherical adsorptive carbon. The fine granules enter even the smallest gaps and scratch the surfaces. Fine granules having entered the space 21*a* of the measuring vessel 21 fall through the gaps among the granules of spherical adsorptive carbon and deposit on the top face of the shutter 24. Then, when the measuring vessel 21 slides along the shutter 24, the fine granules may enter the gap between the bottom face 21*e* of the measuring vessel 21 and the top face of the shutter 24 and damage their surfaces. However, when the width of the gap d between them is smaller than any of the diameters of spherical adsorptive carbon granules to be measured and greater than the diameter of fine granules not to be measured, the fine granules deposited in the space 21*a* are passed through the gap d and separated and removed from the spherical adsorptive carbon. Here, "any of the diameters of spherical adsorptive carbon granules to be measured" means the diameter of the smallest particles in the multiplicity of granules to be measured. This is easy to understand in this embodiment since the granules are spherical. In general, it means the smallest diameter of the granules. For example, in the case of elliptical granules, it means the minor axis thereof. Since the spherical adsorptive carbon has a diameter between 0.05 and 1 mm in this embodiment as described before, the width of the gap d is not greater than 0.05 mm, preferably not greater than 0.04 mm, more preferably not greater than 0.035 mm. The lower limit of the width of the gap d depends on the granular object to be measured. In the case of spherical adsorptive carbon, it is 0.01 mm or greater, preferably 0.02 mm or greater.

Moreover, since the bottom face 21*e* of the measuring vessel 21 is formed by the abrasion resistant material 21*c*, the measuring vessel 21 is less likely to be damaged even if fine particles collide with the bottom face 21*e* as the measuring vessel 21 is reciprocated.

A packaging apparatus according to a second embodiment of the present invention is described with reference to the schematic view of FIG. 3. FIG. 3 shows an apparatus for packaging spherical adsorptive carbon provided with a measuring device 20 according to the first embodiment of the present invention.

A hopper 10 is disposed above the measuring device 20. The hopper 10 is a container having a wide upper opening and narrowing gradually toward the lower end. The lower end of the hopper 10 is opened and communicated with a filling nozzle 16. The hopper has a heater 12, and the spherical adsorptive carbon in the hopper is heated at 55 to 80° C. Alternatively, hot air from a heater may be passed through the hopper to heat the spherical adsorptive carbon at 60 to 80° C.

The filling nozzle 16 under the hopper 10 is a thin pipe so that the spherical adsorptive carbon in the hopper can be discharged little by little. The lower end of the filling nozzle 16 is located and opens in the through hole 22*a* of the holder 22.

As described before, the holder 22 is combined with a measuring vessel 21 reciprocable horizontally under the holder 22, a shutter 24 placed under the measuring vessel 21, and springs 23 for pressing the holder 22 against the measuring vessel 21 under the holder 22 to constitute the measuring device 20.

The shutter 24 of the measuring device 20 has a through hole 24*a* with a lower opening communicated with a chute pipe 31. The chute pipe 31 has a funnel-like upper portion with a wide opening for receiving the spherical adsorptive carbon falling through the through hole 24*a* of the shutter 24 and a narrow pipe-like lower portion opened at the lower end.

A tubular tube 90 for packaging the spherical adsorptive carbon is placed below the chute pipe 31 with its opening facing upward. The tube 90 is produced by forming a flat tape-like sheet into a tubular shape below the chute pipe 31. The tube 90 is transversely sealed as described later to form a bag sealed at the bottom.

A sealing device 40 is disposed below the opening of the chute pipe 31 for sealing the tube 90 transversely. The sealing device 40 heat-seals the tube 90 containing spherical adsorptive carbon transversely at a prescribed length by pinching the tube 90 with top seal bars 41. The top seal bars 41, which are two metal blocks with flat ends, are heated by a heater and pinch the tube 90 from both sides to heat-seal the tube 90. While pinching the tube 90 the top seal bars 41 pull down the tube 90 to place the sealed part at the position of the bottom of the next bag for receiving spherical adsorptive carbon.

In synchronization with the motion of the top seal bars 41 of the sealing device 40, a pinching device 50 located right below the sealing device operates. The pinching device pinches the part of the tube 90 to be sealed by the sealing device 40 with air expel guides 51 to expel the air in the tube 90 in order to prevent the produced package from expanding with an increase in temperature. Each of the air expel guides 51 has a bulged upper portion and a recessed lower portion. Therefore, the spherical adsorptive carbon is placed at the bottom of the bag formed from the tube 90, and an upper part of the tube 90 is pressed flat so that nothing can be contained in the upper part of the bag. The top seal bars 41 and the air expel guides 51 are arranged so as to pinch the tube 90 in the same direction.

A cutting device 60 is disposed below the pinching device 50 for cutting the tube 90 containing spherical adsorptive carbon at the sealed parts into packet 91 or package 92 consisting of a plurality of packets 91. The cutting device 60 has two blades which pinch and cut the tube 90. The package 92 of a plurality of packets 91 containing spherical adsorptive carbon and joined end to end may be perforated at the sealed parts left uncut so that packets 91 can be easily separated by hand. Therefore, the cutting device 60 may also have blades each of which has an edge with notches at equal intervals and which are operated at different timing from the cutting blades.

A receiving table 61 is located below the cutting device 60. The receiving table 61 is a tilted plate that allows the cut package 92 to fall obliquely to reduce the impact of the fall. The receiving table 61 has a shock absorbing roller 62 for further reducing the falling speed of the packages 92. The shock absorbing roller 62 is located in such a position that the package 92 passes between two cylindrical rollers of the shock absorbing roller 62 while sliding down on the receiving table 61. Since the package 92 rotate the rollers when passing therebetween, the falling speed of the package 92 is reduced. The shock absorbing roller 62 may have only one roller. Another means for reducing the falling speed of the package 92 may be provided instead of the shock absorbing roller 62. For example, some means for increasing friction may be provided on the receiving table 61.

A cooling device 70 is disposed downstream of the receiving table 61. The cooling device 70 has a conveyor 71 and supports 72 for supporting the package 92 in an obliquely upstanding position arranged on the conveyor 71 and moving together with the conveyor 71. The supports 72 are plates or rods obliquely extending from the conveyor 71. The supports 72 support the package 92 such that the short sides of the package 92 are perpendicular to the transporting direction. Then, a larger number of packages 92 can be supported on the conveyor 71 with the same length. At the end opposite the receiving table 61 where the conveyer 71 turns around, the package 92 falls by gravity. The package 92 falls into a container for packing the package 92, and the package 92 is packed and shipped.

The method of producing the package 92 of spherical adsorptive carbon is next described with reference to FIG. 3. Spherical adsorptive carbon is supplied into the hopper 10 through the upper opening thereof and temporally stored in the hopper 10. The spherical adsorptive carbon is heated at 60 to 80° C. by the heater 12 while being stored in the hopper 10. This is to package the spherical adsorptive carbon at the possible highest temperature in order to prevent the contents in the package 92 from expanding to form voids in the packets 91 in which they can move with an increase in temperature after packaging.

The spherical adsorptive carbon gradually descends in the hopper 10 and flows into the filling nozzle 16 from the lower end of the hopper 10. The inside diameter of the filling nozzle 16 is so selected that an appropriate amount of spherical adsorptive carbon can be passed through the filling nozzle 16 and discharged from the hopper 10. A valve may be provided in the filling nozzle 16 for controlling the amount of spherical adsorptive carbon to be discharged.

As described before, the spherical adsorptive carbon is supplied from the filling nozzle 16 to the measuring vessel 21 through the holder 22, measured into a prescribed amount by the measuring vessel 21 and discharged into the chute pipe 31 through the shutter 24.

At the same time when the spherical adsorptive carbon is supplied to the hopper 10, a sheet wound in a roll is pulled out at a prescribed speed and formed into a tubular shape in the vicinity of the lower end of the chute pipe 31. The overlapped portions of the sheet are heat-sealed to form the tube 90. The tube 90 is sealed transversely at a prescribed position by the sealing device 40 as described later. The tube 90 is formed into a bag sealed at the bottom and placed with its opening facing the lower opening of the chute pipe 31.

The spherical adsorptive carbon measured by the measuring device 20 is poured into the bag-shaped part of the tube 90 through the chute pipe 31 and is heaped up in the lower part of the bag-shaped part. Then, the air expel guides 51 of the pinching device 50 pinch the bag-shaped part from both sides to expel the air therein. Almost as soon as the pinching device 50 expels the air, the tube 90 is sealed transversely by the sealing device 40 at a position immediately above the part from which air has been expelled by the pinching device 50. The tube 90 is made of a multi-layer film having an inner layer of a heat-sealable plastic film and can be sealed when pinched by heated top seal bars 41. The top seal bars 41 may seal the tube 90 by means other than heat sealing, such as ultrasonic sealing.

The top seal bars 41 move down a distance equal to the length of the bag for the spherical adsorptive carbon while pinching the tube 90. By this movement, the sealed part made to close the bag containing spherical adsorptive carbon becomes the bottom of the next bag-shaped part of the tube 90.

The packets 91 containing spherical adsorptive carbon and sealed transversely are cut at the sealed parts into for example each packet or a package of three packets by the cutting device 60. When a package of a plurality of packets is cut off, the package may be perforated at the sealed parts between the packets by being pinched between blades each having an edge with notches at equal intervals so that the packets can be easily separated by hand.

The package 92 cut by the cutting device 60 slides down on the receiving table 61, is reduced in falling speed by the shock absorbing roller 62 and falls down onto the cooling device 70. Since the package 92 falls onto the cooling device 70 at a low speed, the seals at the bottoms of the package 92 is not damaged by the impact of the fall. The package 92 fed onto the cooling device 70 are held in an obliquely upstanding position by the supports 72 and transported on the conveyor 71 of the cooling device for one to five minutes. The package 92 may be transported on the conveyor 71 at room temperature or exposed to cool air while being transported. During this time, the spherical adsorptive carbon heated to 60 to 80° C. in the hopper 10 and still keeping the temperature is cooled to almost room temperature. When cooled, the package shrinks and the spherical adsorptive carbon cannot move any more in the packets 91.

When the package 92 is transported to an end of the conveyer 71, the conveyor 71 turns downward and the package 92 falls by gravity. A packing box is placed at the position where the package 92 falls. When a predetermined number of packages 92 are put in the box, the box is carried away.

Here, spherical adsorptive carbon to be measured by the measuring device according to the first embodiment of the present invention or packaged by the packaging apparatus according to the second embodiment of the present invention is described. Spherical adsorptive carbon is a porous spherical carbon material and has a diameter between 0.05 and 1 mm. Spherical adsorptive carbon with a particle size between 0.2 and 0.5 mm has a hardness between 600 and 1500 mN per granule with a high incidence between 800 and 1300 mN per granule and a mode of approximately 1000 mN per granule as measured with a powder characteristic measuring meter manufactured by Tsutsui Rikagaku Kikai Co., Ltd (breaking value in a breakdown test on spherical adsorptive carbon). In general, medicine with a similar granule size range has a hardness of approximately 200 mN per granule or less as measured by the same method. The measuring device according to the present invention is suitable to measure spherical adsorptive carbon having such a high hardness since spherical adsorptive carbon granules cannot be caught between the measuring vessel 21 and the holder 22 and between the measuring vessel 21 and the shutter 24 to cause damage of the measuring vessel 21, the holder 22 and the shutter 24.

Although spherical adsorptive carbon is herein taken as the granular object to be measured and packaged, the measuring device, the packaging apparatus and the package production method according to the present invention are applicable to other granular object.

Description of Reference Numerals and Symbols

Figure 1A:
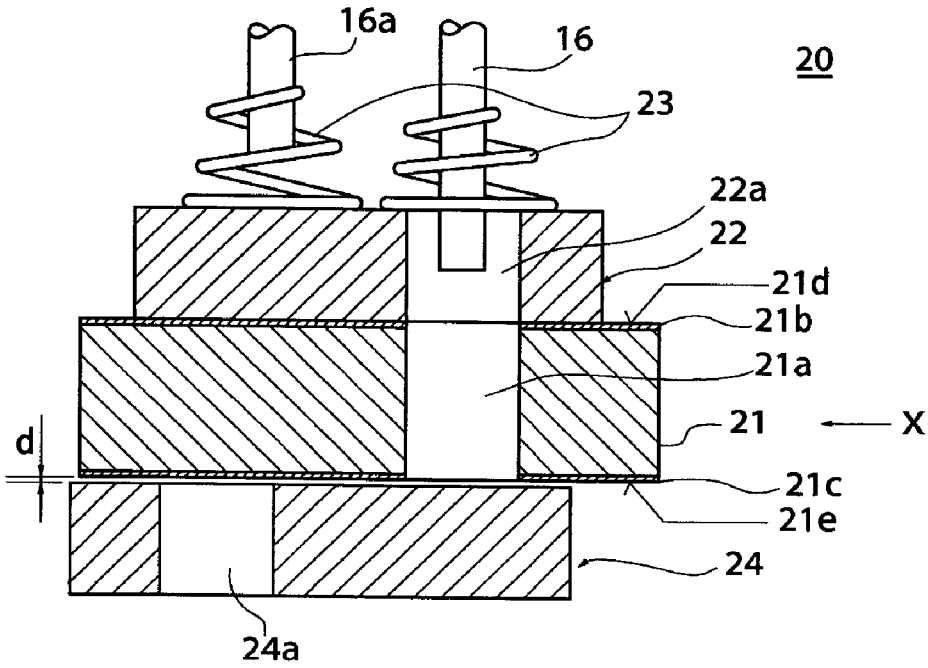
FIG. 1 is a cross-sectional view, illustrating a measuring device according to a first embodiment of the present invention.
Figure 1B:
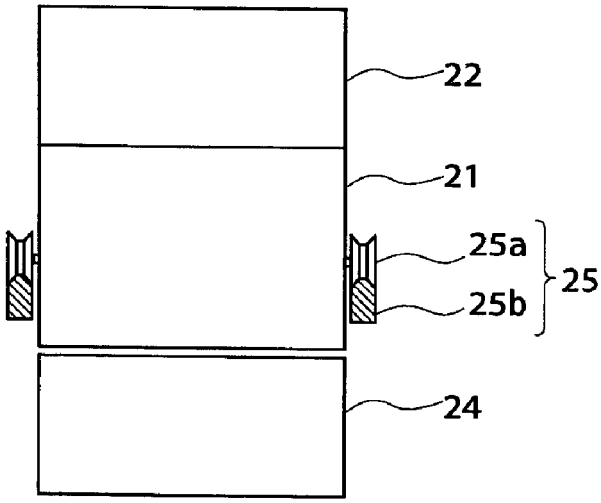
Figure 2A:
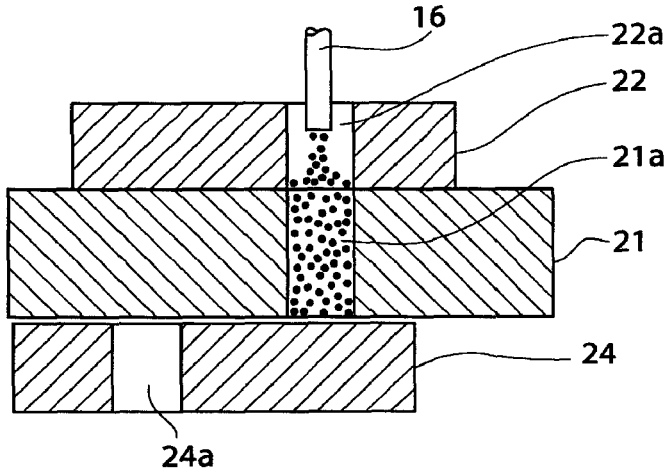
FIG. 2 is a cross-sectional view, illustrating the operation of the measuring device according to the first embodiment of the present invention.
Figure 2B:
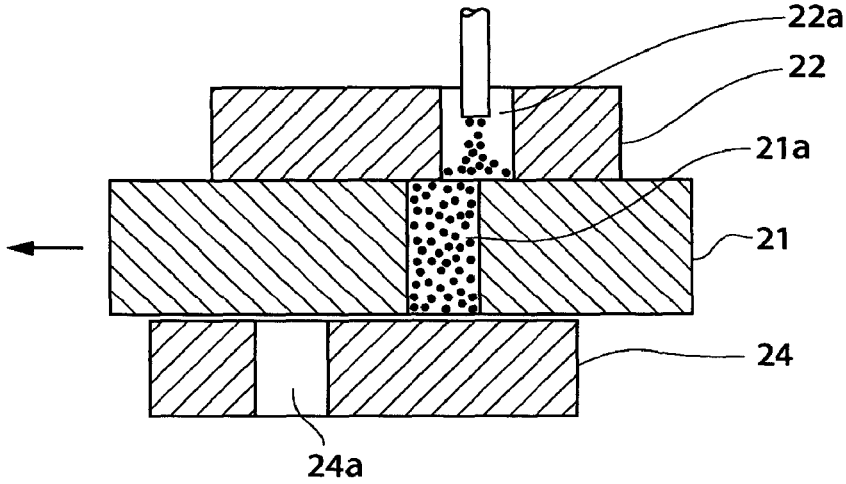
Figure 2C:
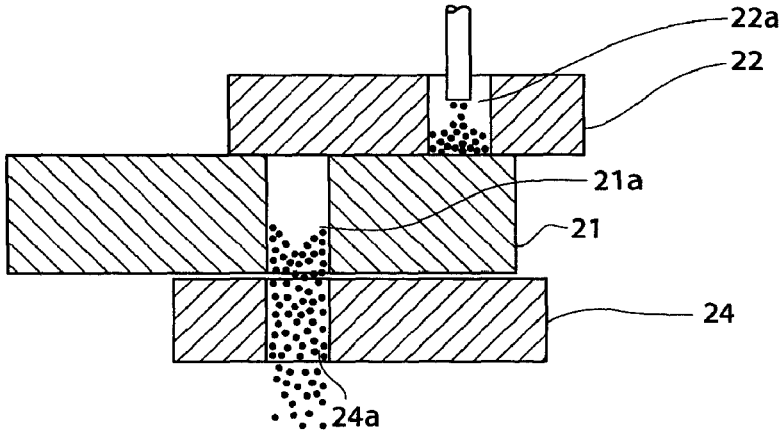
Figure 3:
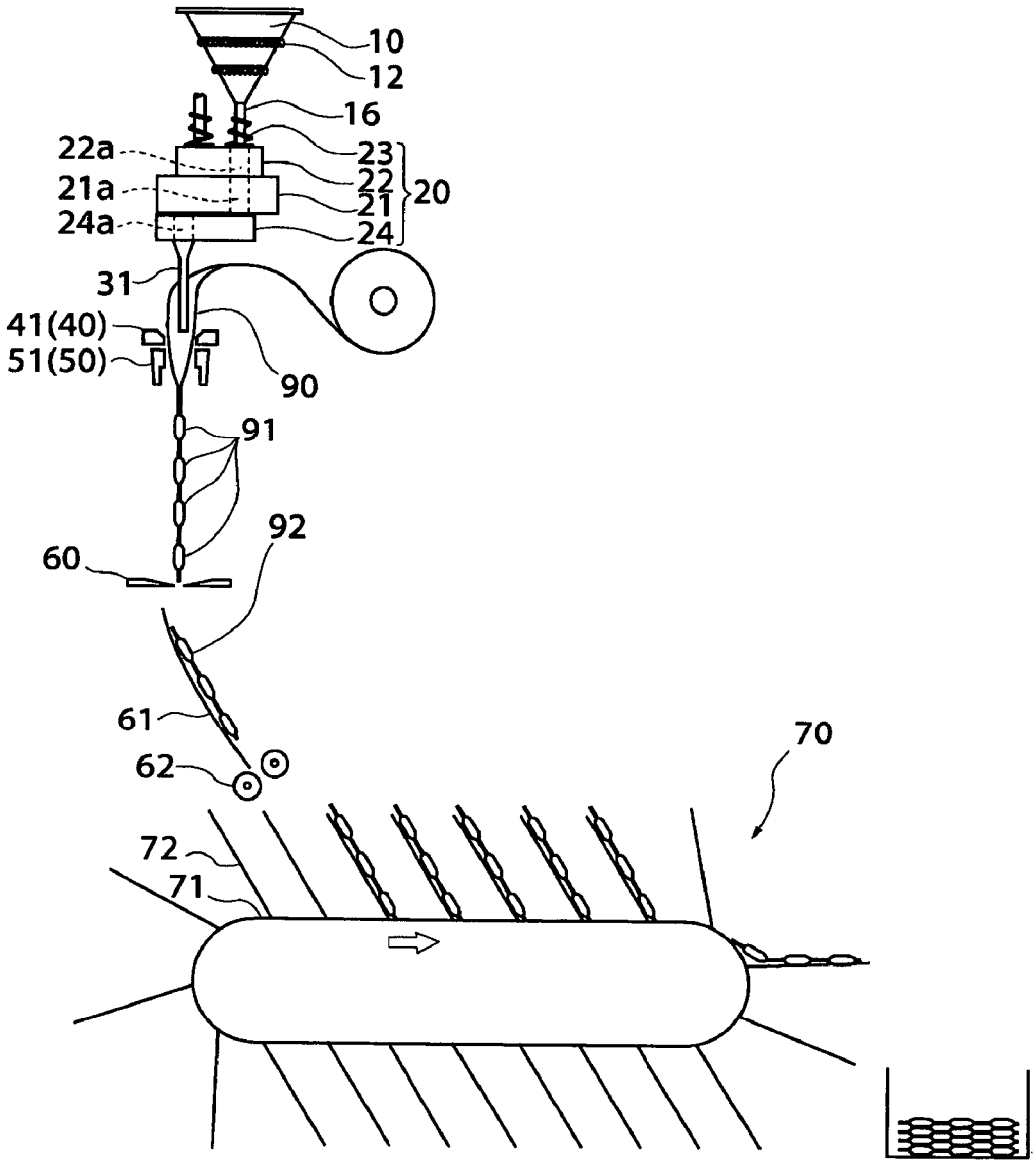
FIG. 3 is a schematic view, illustrating a packaging apparatus according to a second embodiment of the present invention.
Figure 4:
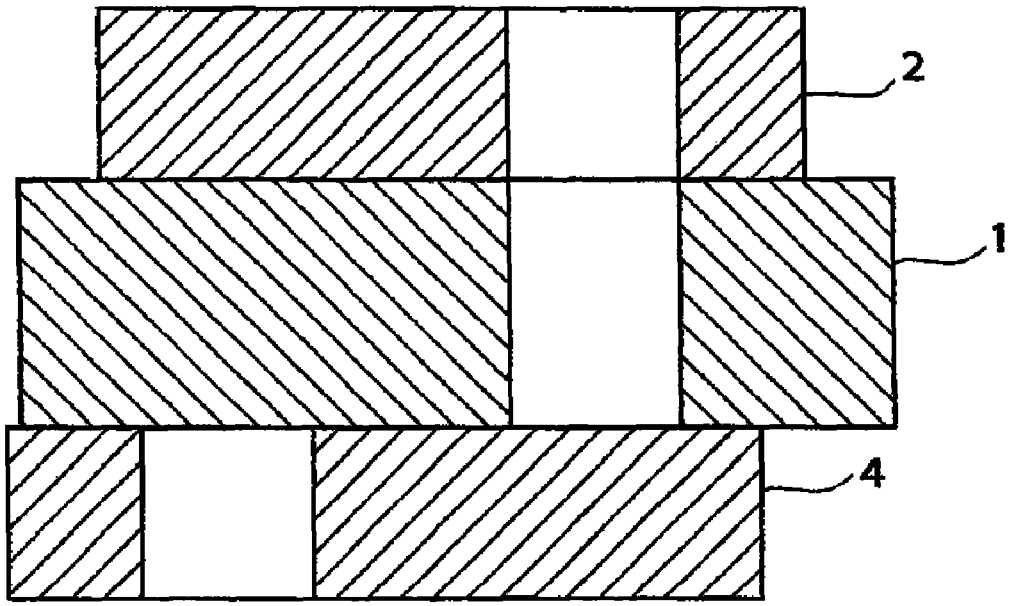
FIG. 4 PRIOR ART
FIG. 4 is a cross-sectional view, illustrating a measuring device according to a conventional art.

16: filling nozzle
20: measuring device
21: measuring vessel
21*a*: space
21*b, c*: abrasion resistant material
22: holder
23: spring (pressing means)
24: shutter
31: chute pipe
40: sealing device
50: pinching device
60: cutting device
61: receiving table
62: shock absorbing roller
d: gap

The invention claimed is:

1. A device for measuring a hard granular object, comprising:

a measuring vessel having a first face, a second face parallel to the first face, and a space formed between the first and second faces for receiving hard granular object supplied from the first face side;

a holder located on the side of the first face, having a through hole communicable with the space, and slidable along the first face;

a shutter located on the side of the second face, having a through hole communicable with the space, and movable parallel to the second face; and a pressing means for pressing the holder against the measuring vessel, wherein the pressing means comprises a spring.

2. The device for measuring a hard granular object of claim 1, wherein there is kept a designated gap between the second face and the shutter.

3. The device for measuring a hard granular object of claim 2, wherein the holder is pressed against the measuring vessel with a force smaller than that required to crush the hard granular object.

4. The device for measuring a hard granular object of claim 2, wherein a part of the first face which slides on the holder is made of an abrasion resistant material.

5. The device for measuring a hard granular object of claim 4, wherein a part of the second face facing the shutter is made of an abrasion resistant material.

6. The device for measuring a hard granular object of claim 2, wherein a part of the holder which slides on the measuring vessel is made of an acetal resin or polyether-ether-ketone.

7. The device for measuring a hard granular object of claim 2, wherein a part of the second face facing the shutter is made of an abrasion resistant material.

8. The device for measuring a hard granular object of claim 2, wherein the space of the measuring vessel for receiving the hard granular object has an opening with its unchamfered edge in the first face.

9. The device for measuring a hard granular object of claim 8, wherein the space of the measuring vessel for receiving the hard granular object has an opening with its unchamfered edge in the second face.

10. The device for measuring a hard granular object of claim 2, wherein the space of the measuring vessel for receiving the hard granular object has an opening with its unchamfered edge in the second face.

11. The device for measuring a hard granular object of claim 1 wherein the holder is pressed against the measuring vessel with a force smaller than that required to crush the hard granular object.

12. The device for measuring a hard granular object of claim 11, wherein a part of the first face which slides on the holder is made of an abrasion resistant material.

13. The device for measuring a hard granular object of claim 1, wherein a part of the first face which slides on the holder is made of an abrasion resistant material.

14. The device for measuring a hard granular object of claim 13, wherein a part of the second face facing the shutter is made of an abrasion resistant material.

15. The device for measuring a hard granular object of claim 1, wherein a part of the holder which slides on the measuring vessel is made of an acetal resin or polyether-ether-ketone.

16. The device for measuring a hard granular object of claim 1, wherein a part of the second face facing the shutter is made of an abrasion resistant material.

17. The device for measuring a hard granular object of claim 1, wherein the space of the measuring vessel for receiving the hard granular object has an opening with its unchamfered edge in the first face.

18. The device for measuring a hard granular object of claim 17, wherein the space of the measuring vessel for receiving the hard granular object has an opening with its unchamfered edge in the second face.

19. The device for measuring a hard granular object of claim 1, wherein the space of the measuring vessel for receiving the hard granular object has an opening with its unchamfered edge in the second face.

* * * * *